US005273022A

United States Patent [19]

Leven

[11] Patent Number: 5,273,022

[45] Date of Patent: Dec. 28, 1993

[54] WEIGHT SUPPORT FOR ARCHERY BOW STABILIZERS

[76] Inventor: William L. Leven, 6480 Katherine Ave., #62, Simi Valley, Calif. 93063

[21] Appl. No.: 924,673

[22] Filed: Aug. 4, 1992

[51] Int. Cl.[5] ..... F41B 5/00

[52] U.S. Cl. ..... 124/89; 124/88

[58] Field of Search ..... 124/88, 89

[56] References Cited

U.S. PATENT DOCUMENTS

| | | | |
|---|---|---|---|
| 3,524,441 | 10/1970 | Jeffery . | |
| 4,245,612 | 1/1981 | Finlay | 124/89 |
| 4,553,522 | 11/1985 | Topping . | |
| 4,570,608 | 2/1986 | Masterfield | 124/89 |
| 4,615,327 | 10/1986 | Saunders . | |
| 4,779,602 | 10/1988 | Hess, Sr. . | |
| 4,893,606 | 1/1990 | Sisko . | |
| 4,936,283 | 6/1990 | Izuta | 124/89 |
| 4,982,719 | 1/1991 | Haggard | 124/89 |

*Primary Examiner*—Dave W. Arola
*Assistant Examiner*—Anthony Knight
*Attorney, Agent, or Firm*—Christie, Parker & Hale

[57] ABSTRACT

An apparatus for use with an archery bow stabilizer comprises a resilient elastomeric member, a housing having an open end, means for mounting the elastomeric member in the housing so that an end of the member extends from the housing, means for coupling the apparatus to an archery stabilizer arm at one end, and a stabilizer weight at the opposite end for providing an angularly flexible connection of selected resilience. A weight support arm for an archery bow stabilizer comprises an elongate tubular housing, coupling means for securing the stabilizer to an archery bow, and damping means disposed in the housing in a relaxed position for providing reduction of vibration of the stabilizer arm and the archery bow.

18 Claims, 3 Drawing Sheets

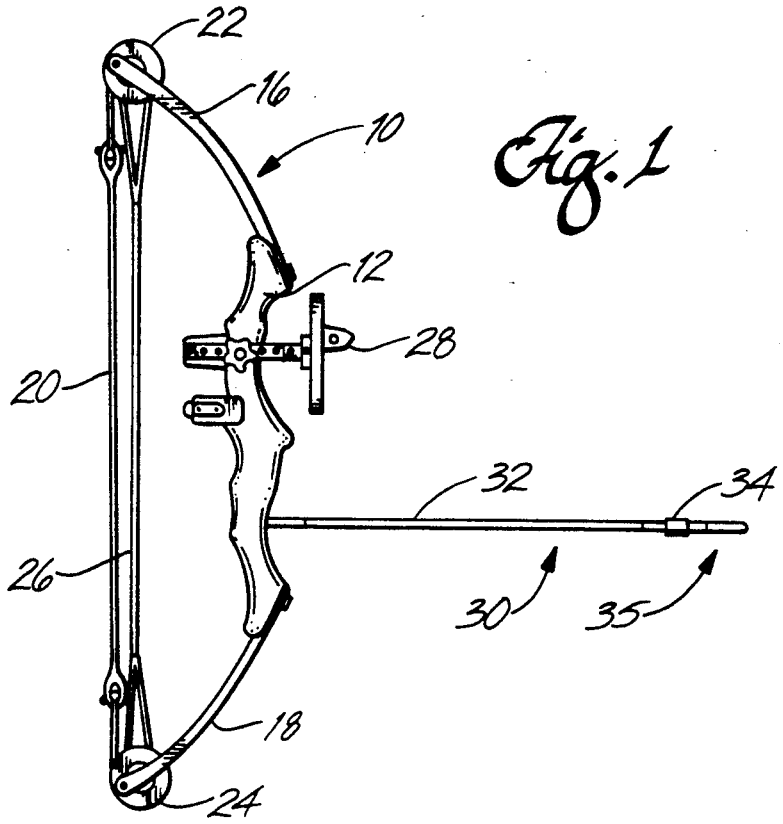
Fig. 1
Fig. 2
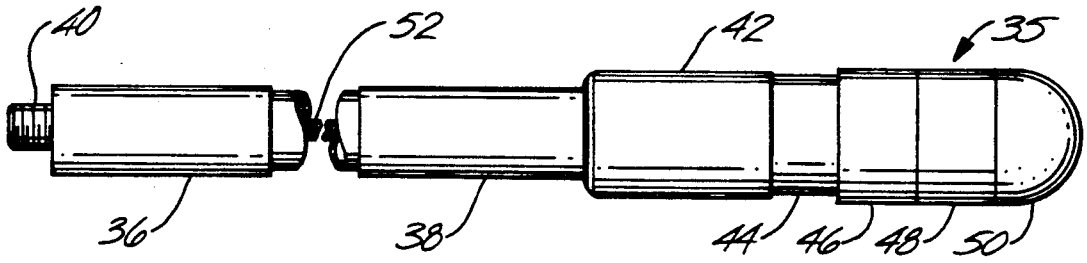

WEIGHT SUPPORT FOR ARCHERY BOW STABILIZERS

FIELD OF THE INVENTION

The present invention relates generally to an archery accessory. More particularly, it relates to an archery bow stabilizer and a resilient mounting adapted to be attached between a stabilizer arm and a stabilizer weight, for the purpose of better reducing bow movement and vibration of the stabilizer on the bow upon release of the arrow.

BACKGROUND OF THE INVENTION

Various stabilizers and vibration dampeners have been developed to both positionally stabilize a bow and to absorb the shock occurring in the bow when an arrow is discharged from an archery bow. For example, U.S. Pat. No. 3,524,441 discloses an archery bow stabilizer having an isolated shock cushion mounting base which provides ready attachment to and removal from the archery bow. As disclosed by the '441 patent, a resilient compressible elastomeric bushing in the stabilizer base provides a captive support for attaching to the bow a stabilizer arm which carries a weight at its opposite end. One disadvantage is that, because of the location of that resilient coupling between the stabilizer arm and the bow riser, the bow can twist or wriggle in the archer's hand relative to the weight which tends to remain stationary.

U.S. Pat. No. 4,553,522 discloses a complicated device consisting of five pivotally-connected sections for resiliently mounting a pair of stabilizer rods for universal angular adjustment on a bow. The device has a central member fixed to the bow anda cylindrical portion projecting from each end, a pair of intermediate members, and a pair of outer-end member, each of the outer-end members having means at one end for attachment of a stabilizer rod. The '522 patent has a disadvantage because it requires a complicated device to properly adjust the stabilizer and the archery box. Also, that device places resilient flexure mounts for the stabilizer rods at the bow-ends of the stabilizer rods.

U.S. Pat. No. 4,779,602 discloses a rod that is threaded at one end into a bow riser to extend forwardly therefrom. An inertia sleeve is slidableon the rod and is biased toward the bow by a stiff spring. The inertia sleeve moves forward against the force of a compression spring when the bowstring is released. The sleeve is then snapped back by spring force toward the bow to apply to the bow an impact which counteracts the tendency of the bow to jump from the archer's hand upon release of the bowstring. A balance weight is fixed to the end of the rod forwardly from the bow.

U.S. Pat. No. 4,893,606 discloses a distributed mass in an inertial archery bow stabilizes and vibration damper which, in use, is rigidly affixed to a bow riser. The '606 patent employs an internal flow-limiting structure and a high-density fluid initial mass to achieve stabilization against forward thrust of the bow. Such stabilization is provided by the relatively large mass of the high-density fluid retained within the tubular rigid body which encloses the stabilizing subassembly. Vibration damping is achieved by movement of fluid through and around the flow-limiting structure within the body. The device also provides a measure of static balance to the bow as it is held in a drawn state, but it does not meaningfully address the problem of the tendency of the bow to twist in the user's hand upon release of the drawn bowstring.

U.S. Pat. No. 4,615,327 discloses an archery bow stabilizer which includes a pair of annular weights which are carried in normally aligned manner at one end of a stabilizer rod which is rigidly affixable to a bow riser at its other end. The weights are connected to each other and to the rod by resilient elastomeric elements disposed within the annular weights. The weights can move out of alignment with each other, and out of alignment with the rod, against the bias of the resilient elements, when the bow riser experiences torque upon release of the bow from a drawn condition. The device provides a measure of torque stabilization to the bow. The device is heavy, and such additional weights as may be needed can be affixed to the forward end of the forwardmost annular weight. Because of the mass of the device, it is difficult to use it effectively in applications which call for customization to the requirements of a range of bows of different kinds and to the needs of a range of archers.

It is desirable to have a bow stabilizer which allows weights of different size to move relatively freely in response to torquing of a bow on an end of a stabilizer arm which has its other end rigidly connected to the bow riser. It is also desirable that the stabilizer arm not vibrate during times when the stabilizer responds to dynamic conditions in the bow. Such a stabilizer causes less hand shock and better arrow flight, resulting in the consistent accuracy desired by archers. It is also desirable to have a device which provides for ready variability of the stabilizer weights so that the weight used in a particular stabilizing situation can be customized to the archer and to the bow.

SUMMARY OF THE INVENTION

The present invention addresses the need identified above. It provides a simple, effective and efficient resilient weight mounting for use in coupling a desired weight assembly to the weight end of a stabilizer arm which is rigidly affixable at its other end to a bow riser. Because of its simplicity and relatively-low cost, an archer can have in inventory a number of such devices having different elastic characteristics suited to the different performance characteristics of compound bows and recurved bows used by that archer.

Generally speaking, the present invention provides an improved weight mount apparatus for use with an archery bow stabilizer. The mount apparatus defines a flexible coupling of selected resilience between a weight end of an archery bow stabilizer arm and a stabilizer weight. The arm weight end and the weight can be defined for direct connection to each other. The mount apparatus comprises an elongate elastomeric member of selected geometry and with resilient properties selected and defined to cause the member to normally hold a stabilizer weight substantially coaxial with a stabilizer arm in use of the member between an arm and a weight. Separate connection means are coupled to opposite ends of the member for movement angularly relative to each other on deformation of the member angularly and axially, and for coupling one end of the member to a stabilizer arm weight end and for coupling the opposite end of the member to a stabilizer weight.

Another embodiment of the invention, in terms of apparatus, comprises a resilient elastomeric member, a housing which comprises a cylindrical tube having a cylindrical skirt portion and a base portion closing an end of the cylindrical skirt portion, and an opposite end of the skirt portion which is open. The apparatus also includes means for mounting the elastomeric member in the housing so that a first end of the member extends from the open end of the housing skirt portion. Means are provided for coupling the housing base end to a weight end of a stabilizer arm and for coupling a stabilizer weight to the first end of the elastomeric member. When in use, the apparatus lies between the stabilizer arm and the stabilizer weight and provides an angularly flexible connection of selected resilience.

The present invention also provides an archery bow stabilizer arm for use to define a stabilizer connection between an archery bow and a stabilizer weight. The archery bow stabilizer arm comprises an elongate tubular housing, and coupling means for securing the archery bow stabilizer arm to an archery bow. The coupling means includes a first end coupling and a second end coupling. The two couplings are sealably attached to opposite ends of the tubular housing; at least one of the couplings is externally threaded. The archery bow stabilizer arm also includes a damping means which is internally disposed, in a relaxed position, in the tubular housing. When in use, the damping means provides reduction of vibration of the housing and the archery bow.

BRIEF DESCRIPTION OF THE DRAWINGS

The previously mentioned features and advantages of the invention, as well as other features and advantages of the invention, will be more apparent from a reading of the following detailed description of presently preferred and other embodiments of the invention in conjunction with thte accompanying drawings in which:

FIG. 1 shows an archery bow having attached thereto a stabilizer constructed in accordance with the present invention;

FIG. 2 is a cutaway and enlarged elevational view of the preferred embodiment of the stabilizer shown in FIG. 1;

DETAILED DESCRIPTION

Figure 3:
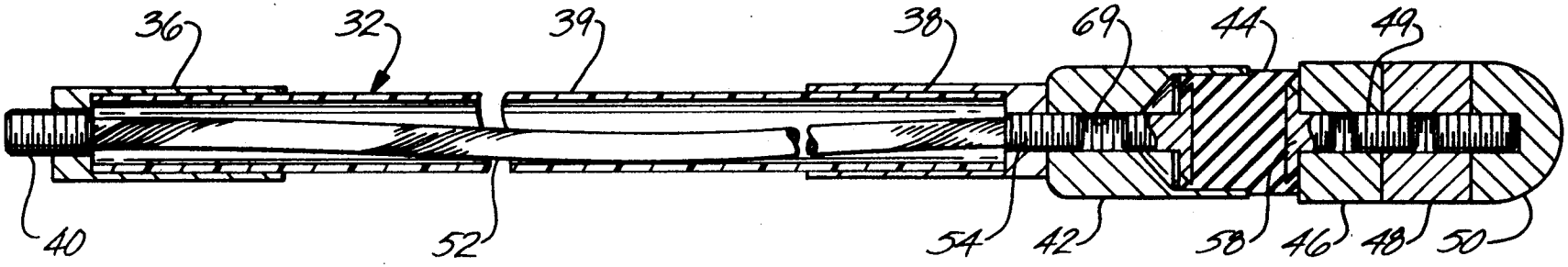
FIG. 3 is a cross-sectional elevation view of the stbiliazer shown in FIG. 2 showing a form of resilient weight amount useful in the stabilizer.

FIG. 1 shows a compound archery bow 10 of a conventional type having a rigid handle riser portion I2 to the opposite ends of which are affixed upper and lower resiliently flexible limbs 16 and 18. A bowstring 20 is connected between a pair of cables 26 which extend in known manner over cam-action pulleys 22 and 24 carried by limbs 16 and 18. An archery sighting device 28 is attached to the riser 12 A stabilizer 30 is engaged into a threaded opening in the forward (toward the target) face of the riser, which opening often is provided in commercially available bows. The stabilizer has a stabilizer arm 32 and a weight mount apparatus 34, both of which preferably are constructed in accordance with the present invention, and a stabilizer weight 35. The weight mount 34 is connected between the forward or weight end of arm 32 and weight 35.

Now referring to FIGS. 2 and 3, the stabilizer arm 32 has affixed to it, as by bonding, a first light weight metal end fitting 36 which defines an externally threaded stud 40. The stud adapts that end of arm 32 to be coupled to the bow riser via the threaded hole provided in the forward face of the riser. The stabilizer arm further includes an internally-disposed energy-absorbing member 52 which can be, but need not be, sealably attached to end fitting 36 and also to a second lightweight metal arm end fitting 38 which is affixed to arm body 39. The second end fitting is further engaged with the weight mount apparatus 34 which has a housing 42 and an elastomeric member 44. The stabilizer weight assembly 35, as shown in FIG. 2, for example, can be composed of two annular weights 46 and 48 attached to the opposite forward end of the apparatus 34. The stabilizer weight assembly further includes a semi-spherical weight element 50 at its forwardmost end.

As best seen in FIG. 3 energy-absorbing member 52 preferably is a length of braided nylon cord. The cord preferably is attached to the stud 40 at one end, and another coupling stud 54 is attached to the other end of the cord. It is not required that the ends of the cord be attached to either or both of studs 40 and 54. Also, the energy-absorbing member can be defined other than as a length of braided nylon cord; other forms of that members can be a length of flexible rubber rod or a length of flexible energy-absorbing tubing loose inside the tubular stabilizer arm.

Studs 40 and 54 preferably are threaded into end fittings 36 and 38 which are affixed to the opposite ends of a tubular, rigid, light weight arm body 39. Thread cement may be used to secure studs 40 and 54 in their assembled positions in arm end fittings 36 and 38. Energy-absorbing member 52 is in a relaxed position within the tubular arm body or housing. When an arrow is released, member 52, in this relaxed position, provides means for damping vibrations in the stabilizer arm by absorbing the vibrational energy of the arm. The tubular housing 34 preferably comprises graphite material which preferably is clad with a fiberglass wrapping for providing a light-weight and rigid stabilizer arm; other cladding materials can be used.

In a preferred embodiment of the present invention, the coupling stud 54, as shown in FIG. 3, is an externally threaded member which extends coaxially from arm end fitting 38. The stud 54 provides a coupling for engagement for the housing 42 of the weight mount apparatus 34. (Studs 40 and 54 can be provided as Allenhead setscrews). As shown in FIG. 3, the opposite end of the weight mount apparatus defines an externally threaded coaxial stud 58, thus providing a coupling for engagement for the adjacent annular weight 46 which preferably is internally threaded through its length. Weights 46, 48 and 50 are interconnected coaxially by further externally threaded studs engaged in threaded bores in those weights.

Figure 4:
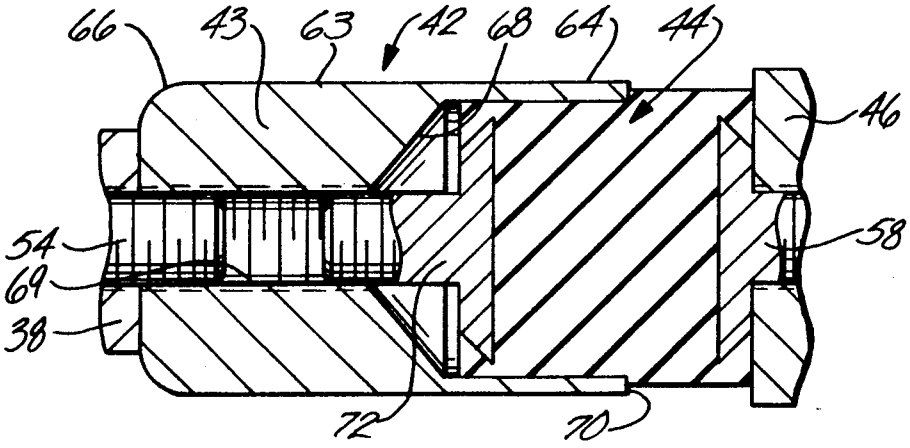
FIG. 4 is a further enlarged fragmentary cross-sectional elevation view of a portion of the stabilizer.

Referring now to FIG. 4, the weight mounting apparatus which is presently preferred has a housing 42 and an elongate resilient elastomeric member 44. The housing comprises a cylindrical member 63 having a cylindrical skirt portion 64 and a base portion 66 substantially closing an end 68 of the cylindrical skirt portion, an opposite end 70 of the cylindrical skirt portion being open. As can be best seen in FIG. 4, the coupling stud 54 of the stabilizer arm is engaged into a threaded axial bore 69 in the base 66 of tubular housing 63. The resilient elastomeric member 44 has, in a preferred embodiment of the invention, a threaded male coupling 72 attached, as by bonding, to one of its ends and another threaded male coupling 58 likewise attached to its opposite end coaxially of coupling 72. The male coupling 58 is engaged in the threaded bore 69 of the annular weight 46, as shown in FIG. 3.

Figure 5:
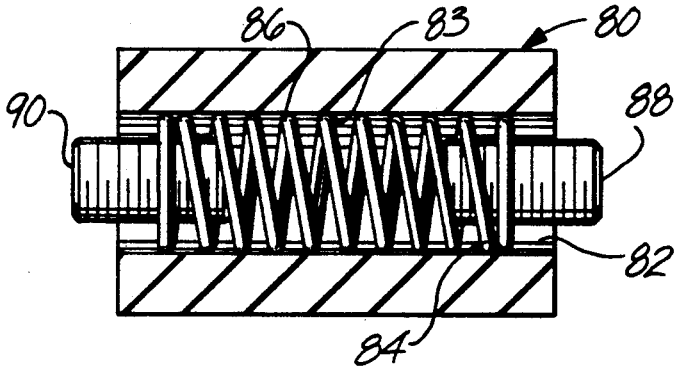
FIG. 5 is a cross-sectional elevation view of a second form of resilient weight mount useful in the stabilzer.

Referring now to FIG. 5, there is shown another studded resilient elastomeric member 80 useful as a weight mount apparatus according to this invention. In the resilient elastomeric member 80, which has a hollow body 82, a coil spring 84 is inserted into the hollow body and provides an interference fit between the inner surface 83 of the member and the outer surface 86 of the spring. Externally threaded studs 88 and 90, which may be Allen-head setscrews, are screwed into or otherwise suitably carried by the opposite ends of spring 84 so that they project outwardly of the ends of member 80. The studs define means for coupling member 80 to a weight assembly at one end and, at its other end, either into housing 42 or directly to the forward end of a stabilizer rod in a case where the weight end of the stabilizer arm defines an internally threaded socket.

Figure 6:
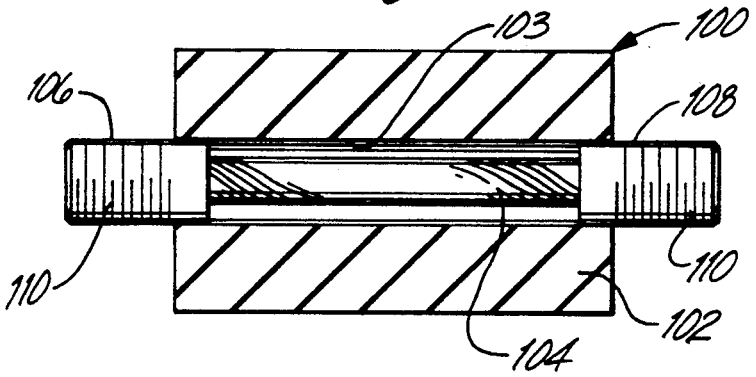
FIG. 6 is a cross-sectional elevation view of a third form of resilient weight mount according to the invention.

Referring now to FIG. 6, there is shown another studded resilient elastomeric member 100 which is useful as a weight mount apparatus in the manner of member 80. Member 100 has an axially hollow body 102. A length of braided metal wire or cable 104 is disposed in the axial bore 103 of member 100. To each end of the cable is securely connected a respective cylindrical coupling member 106, 108. A portion of each coupling member is disposed in bore 103 and a portion projects beyond the adjacent end of member 100. At least the portion of each coupling member 106, 108 which lies outside bore 103 is externally threaded, as at 110, to function as a threaded stud which serves the same function as each of studs 88 and 90 carried by member 80. The cable keeps the coupling members 106 and 108 from separating from member 100 when it is in use, while also accommodating angular flexing and compression of member 100 in use.

Resilient elastomeric members 44, 80 and 100 can bend and flex angularly, and can also compress axially, in response to suitable loads being applied to them. In the absence of such loads, they maintain the configurations shown in FIGS. 4, 5 and 6, respectively, for holding a weight assembly in coaxial alignment with a stabilizer arm upon connection of such a member between a weight assembly and a stabilizer arm.

Figure 7:
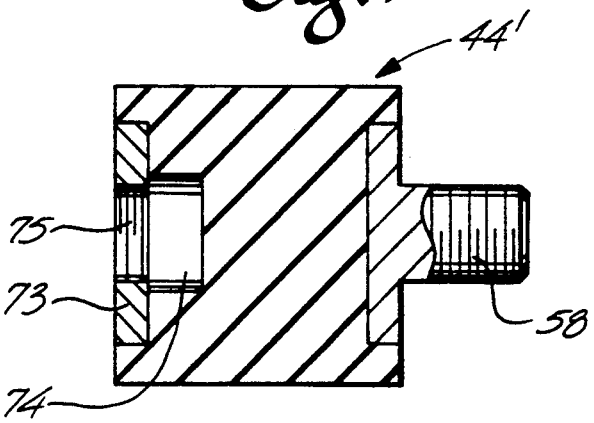
FIG. 7 is a cross-sectional elevation view of a further form of resilient weight mount.

The presence of threaded studs at the opposite ends of members 44, 80 and 100 adapt them for use in housing 42 shown in FIGS. 3 and 4. If desired, suitably modified compressible and angularly flexible, resilient weight mounting members similar to members 44', 80 and 100 can be used directly between a stabilizer arm and a weight assembly. For example, weight mounting member 44' shown in FIG. 7, is like member 44 except that stud 72 of member 44' is replaced by an internally threaded washer-like plate 73 in member 44'; the plate preferably is bonded to the body member 44', and a cavity 74 can be provided in that body adjacent the plate in line with a threaded hole 75 in the plate to accommodate such of the length of arm stud 54 as may project through the plate upon connection of the member to the arm. Similarly, member 80 can be provided without stud 90, e.g., to enable the stabilizer arm stud 54 to be screwed into the interior of spring 86. In like manner, one of the externally threaded coupling members 106, 108 in member 100 can be replaced by an internally threaded socket coupling on the end of cable 104 and within the length of bore 103. Any of these modified forms of weight mounting member can be used with housing 44 by use of an Allen head set screw of suitable diameter in the internally threaded end of the member and in the threaded bore 69 of the housing.

Tests conducted with prototype weight mount devices according to this invention have established that, when connected between a weight assembly and a stabilizer arm, such as an arm 32, in the context of an archery bow, the weight mount device provides stabilization of the bow against torquing, during the interval of arrow release from the bow, which is superior to the stabilization effects provided by a mechanism of equivalent weight constructed in accord with the disclosures of U.S. Pat. No. 4,615,327. The superior stabilization effects are believed to be due to the provision of a localized angularly flexible and compressible resilient structure between the weight assembly and the rigid stabilizer arm, as compared to distributing the angularly flexible and resilient connection within the weight assembly.

The weight assembly in an archery bow stabilizer operates as an inertial mass. The magnitude of the inertial mass is selected, in combination with its placement relative to the bow riser, to achieve the desired static balance condition for the bow as it is drawn and held before release of an arrow, and to achieve effective dynamic balancing effects on the bow in that brief interval, following the instant of arrow release, during which the arrow is in contact with the bowstring or the riser of the bow. It is during that brief interval that the structure of the bow is in violent motion as the bow limbs and related structures and devices move very rapidly from their positions corresponding to the drawn state of the bow to their positions corresponding to the undrawn state of the bow.

It is in that interval that the energy stored in the drawn bow is released and transferred to the arrow. It is in that interval that the bow, in reacting to that release and transfer of energy, tends to twist and turn in the archer's hand at the riser. Such torquing motions of the bow can affect the trajectory of the arrow until it has fully disengaged from the bow.

The presence of an inertial mass in the overall bow apparatus at a location spaced from the bow handle riser increases the polar moment of inertia of the bow and increases its resistance to torquing motion. It has been found that when the stabilizing inertial mass is connected to the rigid weight support arm by a flexible resilient connection which is defined at a localized position between the inertial mass and the arm, the dynamic torque stabilizing effect of the inertial mass on the bow is greatly improved and the angular movements of the bow in the archer,s hand, where it is supported rather than firmly grasped, are significantly reduced.

It has also been found that stiffness of the resilient connection of the inertial mass to its support arm should be matched to the magnitude of the inertial mass for best results for a given archer using a given bow. The given bow can be either a compound bow or a recurved bow. The same archer usually will find that one magnitude of inertial mass is best for use with a compound bow and a different inertial mass is best for use with a recurved bow when the same stabilizer arm is used with both bows. Weight mount devices of different angular stiffness provided by this invention are readily interchangeable, one for another, to suit an archer's needs when using different styles of bows, or when using one style of bow for different purposes, e.g., hunting and competition target shooting. The weight mount devices are compact and can be provided with different degrees of stiffness against bending by varying the hardness of the rubber or other elastomeric used to define the mount devices. Thus, an archer can use a given weight support arm and different amounts of stabilizing weights in different styles of bows, or in a given bow style for different purposes, by maintaining a limited inventory of weight mount devices of different stiffnesses. Also, because the weight mount devices are small and inexpensive, the archer can readily afford to maintain such an inventory of different devices.

The presently preferred hardness of a resilient weight mount device according to this invention is 55 Durometer. Other devices can be provided of selected harness in the range of from about 40 to about 70 Durometer.

The stabilizer arm provided by this invention is rigid while also being of low weight. It adds minimal weight to a bow while serving as an inertial mass support. Therefore, it enhances the ability of the inertial mass to modify the polar moment of inertia of a bow with which it is used.

The foregoing description of presently preferred embodiments of this invention has been presented for purposes of illustration and example of the principles and features of the invention. That description is not exhaustive of all of the structural and procedural forms in which the invention can be embodied or practiced. Therefore, the foregoing descriptions are supportive of, and not narrowly limiting upon, the scope of the invention and of the following claim definitions of invention.

What is claimed is:

1. An apparatus for use with an archery bow stabilizer, the bow stabilizer including a stabilizer arm having a first end adapted to be attached to an archery bow and a second end, the apparatus comprising:

a resilient elastomeric member;

a housing comprising a cylindrical tube having a cylindrical skirt portion, and a base portion substantially closing an end of the cylindrical skirt portion, an opposite end of the skirt portion being open;

means for mounting the elastomeric member in the housing so that an end of the member extends from the open end of the housing skirt portion; and means for coupling the housing base end to the second end of a stabilizer arm and for coupling a stabilizer weight to said end of the elastomeric member, whereby in use of the apparatus it lies between the stabilizer arm and the stabilizer weight and provides an angularly flexible connection of selected resilience.

2. An apparatus as defined in claim 1, wherein the housing has an internally threaded coupling at its base end and the elastomeric member has an externally threded coupling at said end.

3. An apparatus as defined in claim 1, wherein the resilient elastomeric member has an externally threaded coupling at least at one of its ends.

4. An apparatus as defined in claim 1, wherein the elastomeric member has a hollow body and comprises coupling means within the hollow body and extending from at least one of the ends of the member.

5. An apparatus as defined in claim 4, wherein the coupling means comprises a spring having at least one externally threaded element carried at an end thereof and extending outwardly from the elastomeric member.

6. An apparatus as defined in claim 1, wherein the base end of the housing has an internally threaded bore therethrough, and wherein the mounting means includes an element affixed to the elastomeric member and threaded into the bore.

7. An apparatus as defined in claim 1, wherein the coupling means adapts the housing base end for threadably engaging the second end of the stabilizer arm and adapts the elastomeric member for threadably engaging a stabilizer weight to said end of the member.

8. An archery bow stabilizer arm for use in defining a stabilizer connection between an archery bow and a stabilizer weight, comprising:

an elongate tubular housing;

coupling means for securing the housing to an archery bow including a first end coupling and a second end coupling, wherein the first end coupling and the second end coupling are sealably attached to opposite ends of the tubular housing and at least one of the couplings is externally threaded; and flexible damping means loosely disposed in the tubular housing, whereby in use of the stabilizer arm, the damping means provides reduction of vibrations in the housing and the archery bow.

9. An archery bow stabilizer arm as defined in claim 8, wherein the elongate tubular housing comprises graphite material.

10. An archery bow stabilizer arm as defined in claim 8, wherein the coupling means provides for threadably engaging one end of the bow stabilizer arm to an archery bow and for threadably engaging the opposite end of the bow stabilizer arm to a stabilizer weight.

11. An archery bow stabilizer arm as defined in claim 8, wherein the damping means comprises braided nylon cord.

12. An apparatus for use in defining a flexible connection of selected resilience between a weight end of an archery bow stabilizer arm and a stabilizer weight connected to the arm weight end via the apparatus, the apparatus comprising:

an elongate elastomeric member of selected geometry and having resilient properties selected and defined to cause the member to normally hold a stabilizer weight substantially coaxial with a stabilizer arm in use of the member between an arm and a weight; and separate connection means coupled to opposite ends of the member for movement relative to each other on flexing of the member and for coupling one end of the member to a stabilizer arm weight end and for coupling the opposite end of the member to a stabilizer weight.

13. An apparatus as defined in claim 12, wherein the elongate elastomeric member has an internally threaded female coupling at one end of the member and an externally threaded male coupling at the opposite end.

14. An apparatus as defined in claim 12, wherein the elastomeric member has a hollow body and the connection means is within the hollow body and extends from at least one of the ends of the member.

15. An apparatus as defined in claim 14, wherein the connection means comprises a coil spring having at least one externally threaded male coupling attached to one end of the spring and extending outwardly from the member.

16. An apparatus as defined in claim 12 further including a tubular rigid stabilizer arm, coupling means for securing the stabilizer arm to an archery bow, a first end coupling, and a second end coupling, each of the end couplings being sealably attached to the tubular housing, and flexible damping means internally disposed in the tubular housing for providing reduction of vibration of the stabilizer arm.

17. A method for connecting a stabilizing weight to a stabilizer weight support arm affixable to an archery bow comprising the step of interposing between the arm and the weight, for support of the weight on the arm, an angularly flexible resilient member, the weight being connectable directly to the arm but for said interposition of the resilient member between the weight and the arm.

18. The method according to claim 17 including defining the stiffness of the resilient member with relation to the mass of the weight.

* * * * *